US006166614A

United States Patent [19]

Ishikawa et al.

[11] Patent Number: 6,166,614

[45] **Date of Patent: *Dec. 26, 2000**

[54] NONRADIATIVE PLANAR DIELECTRIC LINE AND INTEGRATED CIRCUIT

[75] Inventors: Yohei Ishikawa, Kyoto; Koichi Sakamoto, Nagaokakyo; Atsushi Saitoh, Muko; Kenichi Iio, Nagaokakyo, all of Japan

[73] Assignee: Murata Manufacturing Co., Ltd., Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/092,290

[22] Filed: Jun. 5, 1998

Related U.S. Application Data

[63] Continuation-in-part of application No. 08/832,305, Apr. 3, 1997, Pat. No. 5,986,527.

[30] Foreign Application Priority Data

Jun. 5, 1997 [JP] Japan ..... 9-147714

[51] Int. Cl.[7] ..... H01P 3/00; H01P 3/16

[52] U.S. Cl. ..... 333/239; 333/248

[58] Field of Search ..... 333/238, 239, 333/246, 248, 250

[56] References Cited

U.S. PATENT DOCUMENTS 5,861,782 1/1999 Saitoh ..... 333/248 X

FOREIGN PATENT DOCUMENTS 0735604 10/1996 European Pat. Off. .
0862216 9/1998 European Pat. Off. .

OTHER PUBLICATIONS

Lee, *Slotline Impedance*, IEEE Transion MTT, pp. 666–672, vol. 39, No. 4, Apr. 1991.

Fernanded, et al, *Metallization Thickness in Bilateral and Unilateral Finlines*, Int'l. Frnl. of Infrared & Millimeter Waves, vol.15, No.6, pp.1001–1014 Jun. 1994.

European Search Report issued Sep. 30, 1999 in a related application.

Humberto Cesar Chaves Fernandez et al.; "Dispersion in Finlines on Semiconductor and the S–Parameters of a Step Discontinuity," International Journal of Infrared and Millimeter Waves, vol. 12, no. 5, 1 May 1991 (1991–05–01), pp 505–519, XP000206355, ISSN: 0199271, * page 506, line 31 –line 41 *,* page 510, 33 –line 38, Figures 1A, 8 *.

M. M. Ney et al.: "A Study of Electric–Field Breakdown in E–Plane Lines at Centimeter and Millimeter Wavelengths," IEEE Transactions on Microwave Theory and Techniques, vol. 35, no. 5, May, 1987 (1987–05), pp. 502–509, XP002115616, IEEE Inc. New York, US ISSN: 0018–9480, * Figures 1A, B*.

Eswarappa et al.: "Finlines in Rectangular and Circular Waveguide Housings Including Substrate Mounting and Bending Effects –Finite Element Analysis,"IEEE Transactions on Microwave Theory and Techniques, vol. 37, no. 2, 1 Feb. 1989 (1989–02–01), pp 299–306, XP000005544, ISSN: 0018–9480, * Figure 4 *.

*Primary Examiner*—Paul Gensler

*Attorney, Agent, or Firm*—Ostrolenk, Faber, Gerb & Soffen, LLP

[57] ABSTRACT

A nonradiative planar dielectric line exhibits low transmission losses and is easily connectable to electronic components. A first slot is provided between two electrodes on a first main surface of a dielectric plate. A second slot is provided between two electrodes on a second main surface of the dielectric plate. A first conductor is electrically connected to the electrodes on the first main surface and also covers the first slot. A second conductor is electrically connected to the electrodes on the second main surface and also covers the second slot. An integrated circuit using the above type of dielectric line is also provided. Thus, apparatuses using the above dielectric lines or integrated circuits are miniaturized.

10 Claims, 12 Drawing Sheets

NONRADIATIVE PLANAR DIELECTRIC LINE AND INTEGRATED CIRCUIT

CROSS-REFERENCE TO RELATED APPLICATION

This application is a continuation-in-part application of U.S. patent application Ser. No. 08/832,305 filed Apr. 3, 1997, now U.S. Pat. No. 5,986,527.

BACKGROUND OF THE INVENTION

1. Field of the Invention

The present invention relates to nonradiative planar dielectric lines used in a millimetric wave band or a microwave band. The invention is also concerned with integrated circuits using the above dielectric lines.

2. Description of the Related Art

Microwaves and millimetric waves are electromagnetic waves having a very wide frequency range from 300 MHz to 300 GHZ and are finding widespread use not only in various types of radar, relay, such as ground long-distance calls, television broadcasting waves, and satellite communication, but also satellite broadcasting and mobile communication. Meanwhile, research and development is being actively conducted to form integrated circuits, such as monolithic microwave integrated circuits (MMICs). Thus, the miniaturization of apparatuses utilizing electromagnetic waves in a microwave or millimetric wave band is progressing rapidly, and the range of the use of the electromagnetic waves in the above bands is expanding.

Hitherto, in a microwave or millimetric wave band, transmission lines formed by disposing predetermined electrodes on a dielectric substrate, such as not only waveguides and coaxial lines, but also microstrip lines, coplanar lines, and slot lines, are primarily used. The waveguides are employed for the parts where low transmission losses are required, while the coaxial lines are used as connecting cables between apparatuses. Further, largely, the microstrip lines and the slot lines are used to connect electronic components, since it is easy for them to be connected with electronic components, such as ICs.

A slot line is configured, as shown in FIG. 15, in such a manner that electrodes 421*a* and 421*b* are formed with a predetermined gap on the upper surface of a dielectric substrate 423 having a predetermined thickness h400. This makes it possible to form a slot 424 having a predetermined width W400 between the electrodes 421*a* and 421*b*. In the slot line configured as described above, electromagnetic waves propagate in the longitudinal direction of the slot 424 while forming a mode having an electric field parallel to the width of the slot 424 and a magnetic field H400 parallel to the length of the slot 424, as shown in FIG. 15.

As the transmission line, not only the above types of lines, but nonradiative dielectric lines (NRD guides) are used. The NRD guide is formed by providing a rectangular-prism-shaped dielectric strip between two conductive plates, and exhibits the characteristics of low transmission losses.

However, the foregoing known lines utilizing electromagnetic waves in a millimetric wave or microwave band present the following problems. The waveguides are large, and an apparatus using a waveguide is thus difficult to miniaturize. It is also difficult for the waveguides to be connected to electronic components, such as ICs. Moreover, in the coaxial lines, unwanted high-order modes are generated at frequencies higher than a specific frequency, which is determined by the shape of the cross section of the coaxial line, thereby increasing transmission losses. This makes the coaxial line unusable. Accordingly, if it is desired that the coaxial line be used at a frequency in a millimetric wave band, around 60 GHz, the diameter of the coaxial line should be reduced to as low as 1 mm. This makes it difficult to manufacture the coaxial line. Further, the microstrip lines, the coplanar lines, and the slot lines have high transmission losses, and thus, they are not suited in the use for the parts where low transmission losses are required. Additionally, it is not easy for the conventional NRD guides to be connected to electronic components, such as ICs.

To solve the above problems, the same assignee assigned to the invention of this application has filed a patent application concerning the planar dielectric line and the integrated circuit using the same line in Japanese Patent Application No. 07-069867.

SUMMARY OF THE INVENTION

Accordingly, as in the earlier application, it is an object of the present invention to provide a transmission line exhibiting lower transmission losses and an integrated circuit using the same line, free from the above-described problems.

In order to achieve the above object, according to one aspect of the present invention, there is provided a nonradiative planar dielectric line including a transmission substrate which has a first slot and a second slot. The first slot having a predetermined width and provided between a first electrode and a second electrode is formed on a first main surface of a dielectric plate. The dielectric plate has a relative dielectric constant of 10 or higher and a thickness of 0.3 mm or greater. The second slot having a width substantially equal to the width of the first slot and provided between a third electrode and a fourth electrode is formed on a second main surface of the dielectric plate. The first slot and the second slot face each other. An area formed between the first slot and the second slot serves as a propagating region of an electromagnetic wave. A first conductor is electrically connected to the first electrode and the second electrode and covers the first slot. A second conductor is electrically connected to the third electrode and the fourth electrode and covers the second slot.

According to another aspect of the present invention, there is provided a nonradiative planar dielectric line including a transmission substrate which has a first slot and a second slot. The first slot having a predetermined width and provided between a first electrode and a second electrode is formed on a first main surface of a dielectric plate. The dielectric plate has a relative dielectric constant of 18 or higher and a thickness of 0.3 mm or greater. The second slot having a width substantially equal to the width of the first slot and provided between a third electrode and a fourth electrode is formed on a second main surface of the dielectric plate. The first slot and the second slot face each other. An area formed between the first slot and the second slot serves as a propagating region of an electromagnetic wave. A first conductor is electrically connected to the first electrode and the second electrode and covers the first slot. A second conductor is electrically connected to the third electrode and the fourth electrode and covers the second slot.

With the above arrangement, an electromagnetic wave having a predetermined frequency propagates within the propagating region while being totally reflected alternately on the first main surface of the dielectric plate contacting the first slot and on the second main surface of the dielectric plate contacting the second slot. Further, even if the first slot and the second slot are not completely symmetrical, the radiation wave generated by the asymmetric characteristics of the slots is interrupted by the first and second conductors, thereby suppressing radiation losses, which further reduces transmission losses.

Moreover, by the use of the dielectric plate having a relative dielectric constant of 10 or higher and a thickness of 0.3 mm or greater, or the dielectric plate having a relative dielectric constant of 18 or higher and a thickness of 0.3 mm or greater, approximately 80% or higher or 90% or higher the amount of energy is trapped within the zone which is formed of the slot and the portion 0.4 times as long as the wavelength. Therefore, lines can be positioned in proximity with each other, thereby achieving a higher integrity and smaller integrated circuit.

In the foregoing nonradiative planar dielectric line, a dielectric member having a dielectric constant lower than the dielectric plate may be interposed between the transmission substrate and each of the first and second conductors. Thus, an electromagnetic wave can propagate within the propagating region even with a reduced thickness of the first and second conductors upon comparison with known dielectric lines at the same frequency, thereby reducing the size of the overall nonradiative planar dielectric line.

In the foregoing nonradiative planar dielectric line, the first conductor and the second conductor may be grooved to match the configuration of the first and the second slots, and the grooved surface of each of the first and second conductors may be positioned to face the transmission substrate. With this arrangement, the assembly of the transmission substrate and the conductors is simplified even if a plurality of propagation regions are provided, thereby easily reducing the manufacturing cost.

According to a further aspect of the present invention, there is provided a nonradiative planar dielectric line integrated circuit using any of the above types of dielectric lines. In forming an integrated circuit, a circuit device is further mounted on the transmission substrate. Then, the transmission substrate is assembled with the foregoing first and second conductors.

With the above configuration, circuit devices, such as an oscillation diode and a mixer diode, are mounted on the transmission substrate. It is thus possible to easily form a nonradiative planar dielectric line integrated circuit having a planar circuit.

DESCRIPTION OF THE PREFERRED EMBODIMENTS

Figure 1:
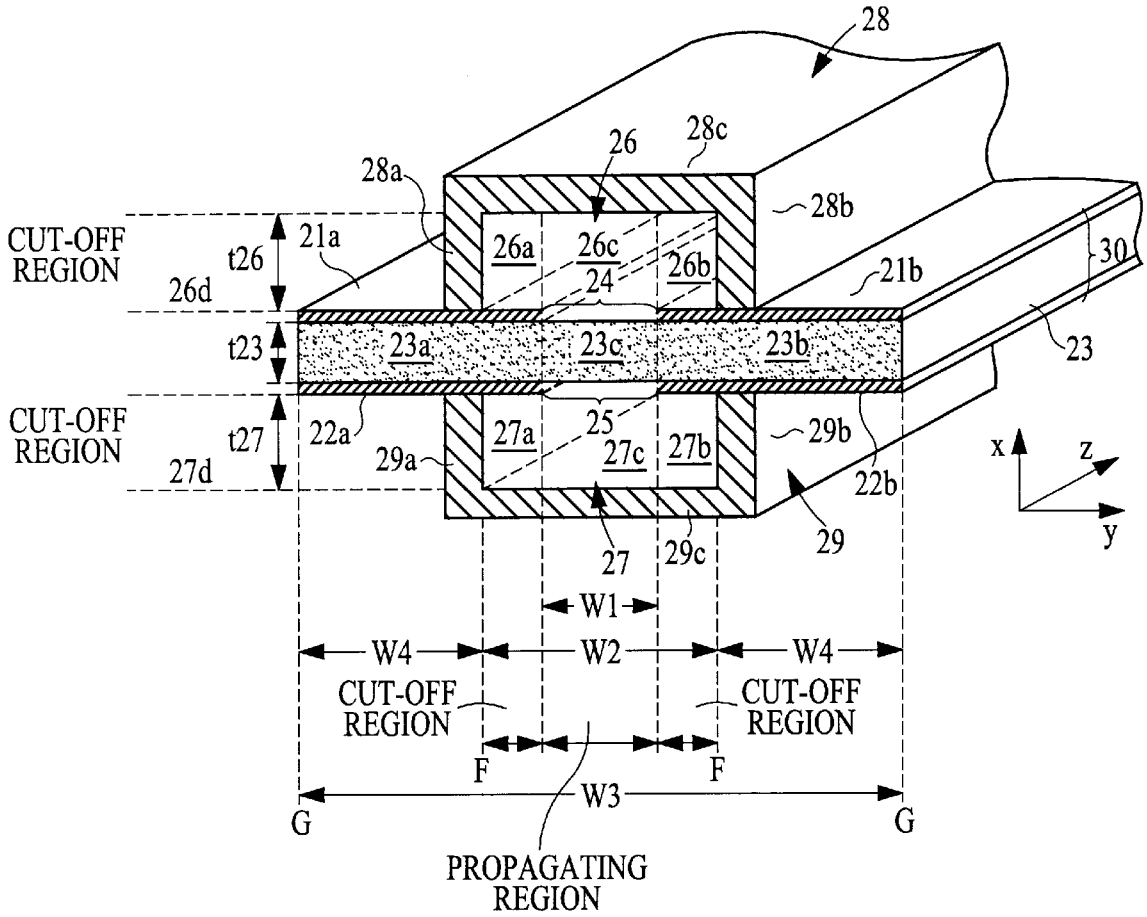
FIG. 1 is a sectional view, partially cut away, illustrating a nonradiative planar dielectric line according to a first embodiment of the present invention.
Figure 2:
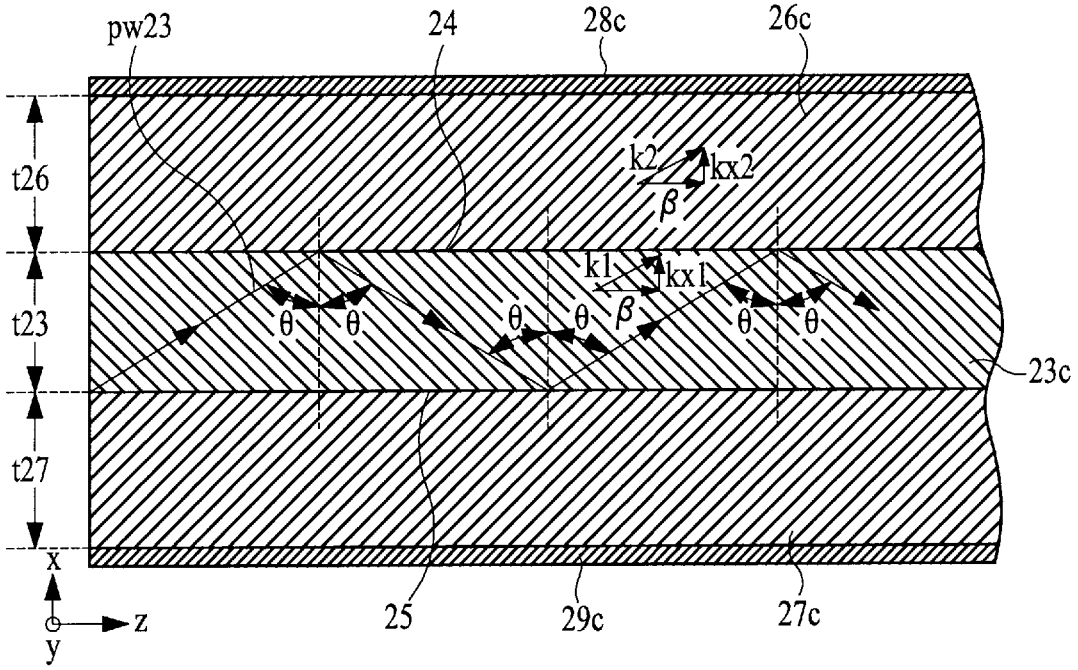
FIG. 2 is a sectional view illustrating a propagating region of the nonradiative planar dielectric line shown in FIG. 1.

A description is given of the configuration of a nonradiative planar dielectric line according to a first embodiment of the present invention with reference to FIGS. 1 and 2.

FIG. 1 is a perspective view partially illustrating a nonradiative planar dielectric line of the first embodiment. The proximal surface of the dielectric line shown in FIG. 1 is represented by cross section. A first electrode 21*a* and a second electrode 21*b* are formed with a predetermined gap W1 on a first main surface (the upper surface in FIG. 1) of a dielectric plate 23, thereby forming a portion indicated by 24 as a first slot. Moreover, a third electrode 22*a* and a fourth electrode 22*b* are formed with a predetermined gap W1 on a second main surface (the lower surface in FIG. 1) of the dielectric plate 23, thereby forming a portion represented by 25 as a second slot. The dielectric plate 23 and the first and second slots 24 and 25 form a transmission substrate 30. A conductor 28 is electrically connected to the first and second electrodes 21*a* and 21*b* and also covers the first slot 24. A conductor 29 is electrically connected to the third and fourth electrodes 22*a* and 22*b* and also covers the second slot 25.

The dielectric plate 23 has a predetermined thickness t23 along the x axis, a predetermined width W3 along the y axis, and a length much greater than the predetermined width W3 along the z axis. The slots 24 and 25 have a predetermined width W1 and are formed at the central portion of the width (y axis) and in parallel to the length (z axis) of the dielectric plate 23. Overlaid on the upper surface of the dielectric plate 23 is a dielectric member 26 having a given thickness t26 and a given width W2 having the same center as the slot 24. An external electrode 28*a* is disposed on an outer surface of the dielectric member 26 in such a manner that it is connected to the electrode 21*a*, and an external electrode 28*b* is disposed to face the external electrode 28*a* in such a manner that it is connected to the electrode 21*b*. Further, an external electrode 28*c* is formed on the upper surface of the dielectric member 26. An external electrode unit (conductor) 28, which is formed by the external electrodes 28*a*, 28*b*, and 28*c*, is electrically connected to the electrodes 21*a* and 21*b* and also covers the slot 24. Similarly, overlaid on the lower surface of the dielectric plate 23 is a dielectric member 27 having a given thickness t27 and a given width W2 having the same center as the slot 25. An external electrode 29*a* is formed on an outer surface of the dielectric member 27 in such a manner that it is electrically connected to the electrode 22*a*, and an external electrode 29*b* is formed to face the external electrode 29*a* in such a manner that it is electrically connected to the electrode 22*b*. Moreover, an external electrode 29*c* is formed on the lower surface of the dielectric member 27. An external electrode unit (conductor) 29, which is formed by the external electrodes 29*a*, 29*b*, and 29*c*, is electrically connected to the electrodes 22*a* and 22*b* and also covers the slot 25.

A portion indicated by 23*c* of the dielectric plate 23 between the opposing slots 24 and 25 serves as a propagating region through which high frequency signals having a given propagation frequency fb propagate. In contrast, portions represented by 23*a* and 23*b* between which the propagating region 23*c* is interposed serve as cut-off regions.

In relation to the relative dielectric constant, the relative dielectric constant ∈r26 of the dielectric member 26 and the relative dielectric constant ∈r27 of the dielectric member 27 are set to be equal, and the relative dielectric constant ∈r23 of the dielectric plate 23 is set to be higher than ∈r26 and ∈r27.

FIG. 2 is a sectional view in the propagating direction of a propagating region of the nonradiative planar dielectric line shown in FIG. 1. An electromagnetic wave pw23 is incident on one point of the upper surface of the dielectric plate 23 contacting the slot 24 at an angle of incidence θ and is reflected at an angle of reflection θ, both angles θ being equal to each other. The upper surface of the propagating region 23*c* of the dielectric plate 23 contacting the slot 24 serves as an interface surface with a propagating region 26*c* of the dielectric member 26. Further, the electromagnetic wave pw23 reflected on one point of the upper surface of the dielectric plate 23 contacting the slot 24 is incident on one point of the lower surface of the dielectric plate 23 contacting the slot 25 at an angle of incidence θ and is again reflected at an angle of reflection θ, both angles θ being equal to each other. The lower surface of the propagating region 23*c* of the dielectric plate 23 contacting the slot 25 serves as an interface surface with a propagating region 27*c* of the dielectric member 27. Thereafter, the electromagnetic wave pw23 propagates within the propagating region 23*c* of the dielectric plate 23 in the TE mode while being reflected on the two interface surfaces alternately. The electromagnetic wave propagating in the TE mode will be referred to as "a TE wave".

The above angle of incidence θ is the angle formed between the propagating direction of the electromagnetic wave pw23 and the normal with respect to the incident point of the slot 24 or 25. The angle of incidence θ is expressed by the following mathematical equation (1) by using the propagation constant k of the electromagnetic wave pw23 and the phase constant β of the TE wave which propagates in the longitudinal direction of the dielectric plate 23.

$$\theta=\sin^{-1}(\beta/k1) \tag{1}$$

When the angle of incidence θ becomes greater than the critical angle θdc expressed by the following mathematical equation (2), the electromagnetic wave pw23 propagates within the propagating region 23*c* without being attenuated while being totally reflected on the upper surface of the dielectric plate 23 contacting the slot 24 and the lower surface of the dielectric plate 23 contacting the slot 25.

$$\begin{aligned}\theta dc &= \sin^{-1}\{\sqrt{(\varepsilon r26/\varepsilon r23)}\} \\ &= \sin^{-1}\{\sqrt{(\varepsilon r27/\varepsilon r23)}\}\end{aligned} \tag{2}$$

Conversely, when the angle of incidence θ becomes smaller than the critical angle θdc, the electromagnetic wave pw23 partially passes through the dielectric member 26 or 27, whereby the electromagnetic wave pw23 propagating within the propagating region 23*c* is attenuated.

The propagation constant k is determined by the frequency of the electromagnetic wave pw23 and the relative dielectric constant ∈r23 of the dielectric plate 23. The phase constant β is determined by the frequency of the electromagnetic wave pw23, the relative dielectric constant ∈r23 and the thickness t23 of the dielectric plate 23. It will be assumed that the x, y, and z axes are taken as illustrated in FIG. 2 and a TE wave propagating along the z axis and having a uniform y component of an electric field (Ey) is used. The propagation constant k1 of the electromagnetic wave pw23 propagating in the dielectric plate 23 is expressed by the following mathematical equation (3) by using the relative dielectric constant ∈r23:

$$k1 = k0\sqrt{(\varepsilon r23)} \tag{3}$$

where k0 indicates the propagation constant of the electromagnetic wave in a vacuum. Similarly, the propagation constant k2 of the electromagnetic wave propagating within the dielectric member 26 or 27 is represented by the following mathematical equation (4).

$$k2 = k0\sqrt{(\varepsilon r26)} = k0\sqrt{(\varepsilon r27)} \tag{4}$$

Further, since the phase constant β of the electromagnetic wave propagating in the dielectric plate 23 is equal to that in the dielectric member 26 or 27, the following mathematical equation (5) holds true:

$$\beta^2=k1^2-kx_1^2=k2^2-kx_2^2 \tag{5}$$

where the propagation constants $kx_1$ and $kx_2$ represent the x components of the dielectric constants k1 and k2 of the electromagnetic wave propagating within the dielectric plate 23 and the electromagnetic wave propagating within the dielectric member 26 or 27, respectively. Moreover, the following mathematical equation (6) holds true between the propagation constants $kx_1$ and $kx_2$.

$$(1/kx_1)\tan(kx_1 \cdot t23/2)-(1/kx_2)\tan(kx_2 \cdot t26)=0 \tag{6}$$

Consequently, equations (5) and (6) are solved to obtain the propagation constants $kx_1$ and $kx_2$ and the phase constant β.

The angle of incidence θ becomes smaller with the decreased frequency of the planar electromagnetic wave pw23. In contrast, the angle of incidence θ becomes greater with the increased frequency of the electromagnetic wave pw23. Thus, the electromagnetic wave pw23 having a frequency not lower than the critical frequency fda, at which the angle of incidence θ is equal to the critical angle θdc, propagates while being totally reflected repeatedly on the upper surface of the dielectric plate 23 contacting the slot 24 and on the lower surface of the dielectric plate 23 contacting the slot 25. Namely, the relative dielectric constant ∈r23 and the thickness t23 of the dielectric plate 23 and the relative dielectric constants ∈r26 and ∈r27 of the respective dielectric members 26 and 27 are set so that a given propagation frequency fb becomes not lower than the critical frequency fda. In other words, the relative dielectric constant ∈r23 and the thickness t23 and the relative dielectric constants ∈r26 and ∈r27 are set so that a planar electromagnetic wave having a given frequency fb is totally reflected on the upper surface of the dielectric plate 23 contacting the slot 24 and on the lower surface of the dielectric plate 23 contacting the slot 25.

Referring back to FIG. 1, the electrodes 21*a* and 22*a* facing each other across the dielectric plate 23 form a plane parallel waveguide having a TE-wave cut-off frequency which is sufficiently higher than a given propagation frequency fb. This makes it possible to form a cut-off region 23*a* next to the propagating region 23*c* in relation to the TE wave having an electric field component in the direction parallel to the electrodes 21*a* and 22*a*. Likewise, the electrodes 21*b* and 22*b* facing each other across the dielectric plate 23 form a plane parallel waveguide having a TE-wave cut-off frequency which is sufficiently higher than the given propagation frequency fb. This makes it possible to form a TE-wave cut-off region 23*b* next to the propagating region 23*c* and opposite to the cut-off region 23*a*.

Further, the external electrode 28*c* and the electrode 21*a* with the dielectric member 26 therebetween form a plane parallel waveguide. The thickness t26 of the dielectric member 26 is set so that the TE-wave cut-off frequency of the above plane-parallel waveguide is adequately higher than the given propagation frequency fb. Accordingly, a TE-wave cut-off region 26*a* is formed next to the propagating region 26*c* between the external electrode 28*c* and the electrode 21*a*. Similarly, a TE-wave cut-off region 26*b* is formed next to the propagating region 26*c* and opposite to the cut-off region 26*a* between the external electrode 28*c* and the electrode 21*b*. Likewise, a TE-wave cut-off region 27*a* is formed adjacent to the propagating region 27*c* between the external electrode 29*c* and the electrode 22*a*, while a TE-wave cut-off region 27*b* is formed adjacent to the propagating region 27*c* and opposite to the cut-off region 27*a* between the external electrode 29*c* and the electrode 22*b*.

Moreover, the external electrodes 28*a* and 28*b* facing each other across the dielectric member 26 form a plane parallel waveguide. Then, the width W2 of the dielectric member 26 is set so that the TE-wave cut-off frequency of the above plane parallel waveguide is sufficiently higher than the given propagation frequency fb. Thus, the dielectric member 26 between the external electrodes 28*a* and 28*b* forms a cut-off region 26*d* in relation to the TE wave having an electric field component perpendicular to the dielectric plate 23. Likewise, the external electrodes 29*a* and 29*b* facing each other across the dielectric member 27 form a plane parallel waveguide. Then, the width W2 of the dielectric member 27 is set so that the TE-wave cut-off frequency of the above plane parallel waveguide is adequately higher than the given propagation frequency fb. Consequently, the dielectric member 27 between the external electrodes 29*a* and 29*b* forms a TE-wave cut-off region 27*d*.

If the width W4 shown in FIG. 1 is set to be one fourth the wavelength of the planar wave, the surface G (the lateral surface of the dielectric plate 23) serves as an open end, and the surface F (the interface between the propagating region 23*c* and the cut-off region 23*b*) serves as a short-circuit end. Then, the planar wave having an electric field component perpendicular to the electrodes 21*a* and 22*a*, and the electrodes 21*b* and 22*b* is trapped only within the propagating region 23*c*. Subsequently, the width W2 of the external conductor is set to be not greater than one half the wavelength of the planar wave on condition that the width W2 is greater than the width W1 of the slot 24 or 25. Then, the above type of planar wave is not generated at all within any of the regions defined by the width W1 through W4.

According to the nonradiative planar dielectric line of the first embodiment configured as described above, the propagating region 23*c* is formed in which a high-frequency signal whose frequency is not lower than the critical frequency fda propagates while it is totally reflected alternately on the upper surface of the dielectric plate 23 contacting the slot 24 and on the lower surface of the dielectric plate 23 contacting the slot 25. Further, the cut-off regions 23*a*, 23*b*, 26*a*, 26*b*, 26*d* , 27*a*, 27*b*, and 27*d* are formed in which the high-frequency signal is attenuated. With this configuration, the planar wave propagates in the longitudinal direction of the dielectric plate 23 while concentrating the electromagnetic field energy of the high-frequency signal whose frequency is not lower than the critical frequency fda on the inside of and around the propagating region 23*c*.

The nonradiative planar dielectric line constructed in accordance with the first embodiment is formed by using the dielectric plate 23 and the dielectric members 26 and 27. Thus, the wavelength of the electromagnetic wave propagating within the dielectric plate 23 and the dielectric members 26 and 27 is shorter than that in a free space. Accordingly, the width and the thickness of the nonradiative planar dielectric line can be reduced, thereby achieving a smaller and lighter dielectric line over rectangular waveguides.

Additionally, in the nonradiative planar dielectric line of the first embodiment, as well as in known slot lines, the electrodes 21*a* and 21*b* or the electrodes 22*a* and 22*b* are directly connectable to other types of electronic components, such as ICs, thereby making it possible to easily connect the foregoing dielectric line to electronic components.

A description is now given of a nonradiative planar dielectric line according to a second embodiment of the present invention with reference to FIGS. 3 through 9.

Figure 3A:
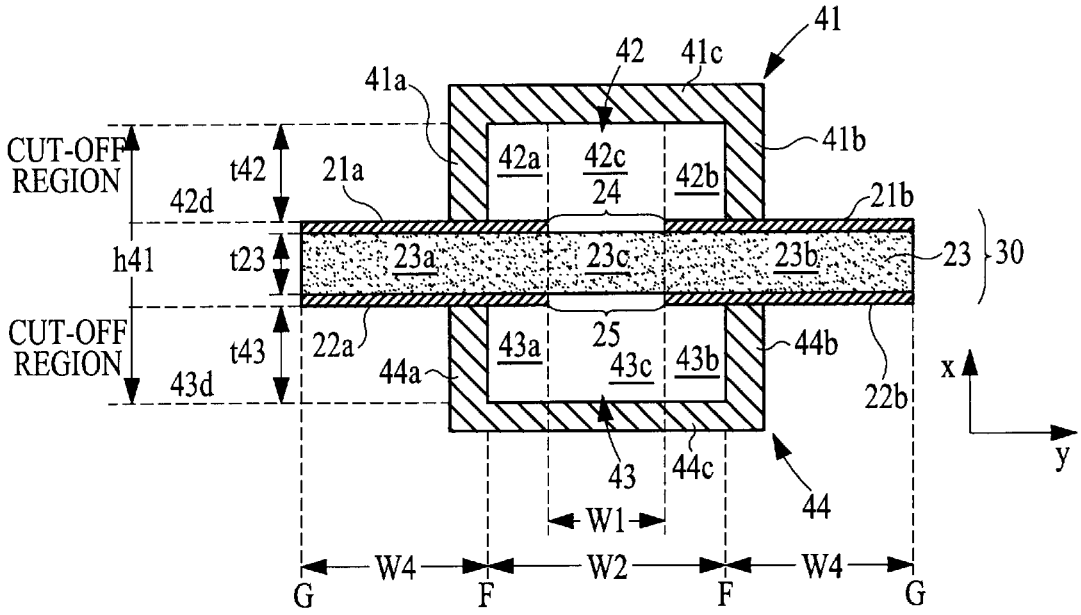
FIG. 3, which is comprised of FIGS. 3A and 3B, is a sectional view illustrating a nonradiative planar dielectric line according to a second embodiment of the present invention.

FIG. 3A is a sectional view of the nonradiative planar dielectric line in cross section perpendicular to the propagating direction. The nonradiative planar dielectric line of the second embodiment differs from the counterpart of the first embodiment in that external conductors 41 and 44 are used in place of the dielectric members 26 and 27 provided with the external electrode units 28 and 29, respectively.

In FIG. 3A, as in the dielectric line illustrated in FIG. 1, electrodes 21*a* and 21*b* are formed with a predetermined gap W1 on the upper surface of a dielectric plate 23, thereby forming a slot 24. Moreover, electrodes 22*a* and 22*b* are disposed with a predetermined gap W1 on the lower surface of the dielectric plate 23, thereby forming a slot 25. Areas indicated by 42 and 43 represent space, and an upper portion 41*c* of the upper external conductor 41 and a lower portion 44*c* of the lower external conductor 44 (41*c* and 44*c* are hereinafter referred to as "external conductor upper portion and external conductor lower portion", respectively) are positioned parallel to each other with a predetermined spacing h41. The dielectric plate 23 having the slots 24 and 25 is provided between the external conductor upper and lower portions 41*c* and 44*c* in such a manner that they are positioned parallel to each other. The spacing t42 between the external conductor upper portion 41*c* and the upper surface of the dielectric plate 23 and the spacing t43 between the external conductor lower portion 44*c* and the lower surface of the dielectric plate 23 are set to be equal to each other.

Further, a lateral portion 41*a* of the upper external conductor 41 and the opposing lateral portion 41*b* of the external conductor 41 are provided with a predetermined gap W2 (the lateral portions 41*a* and 41*b* are hereinafter referred to as "external conductor lateral portions"), and the center of the gap W2 is set to be the same as that of the slot 24. Moreover, the external conductor lateral portions 41*a* and 41*b* are electrically connected to the electrodes 21*a* and 21*b*, respectively. Similarly, a lateral portion 44*a* of the lower external conductor 44 and the opposing lateral portion 44*b* of the external conductor 44 are provided with a predetermined gap W2 (the lateral portions 44*a* and 44*b* are hereinafter referred to as "external conductor lateral portions"), and the center of the gap W2 is set to be the same as that of the slot 25. Moreover, the external conductor lateral portions 44*a* and 44*b* are electrically connected to the electrodes 22*a* and 22*b*, respectively.

In the nonradiative planar dielectric line of the second embodiment, the relative dielectric constant ∈r23 of the dielectric plate 23 is determined as follows. Unlike the first embodiment, the reflection of the electromagnetic wave on the upper surface of the dielectric plate 23 contacting the slot 24 and on the lower surface of the dielectric plate 23 contacting the slot 25 takes place at the interface between the dielectric plate 23 and a free space. Hence, the critical angle θc can be expressed by the following mathematical equation (7):

$$\theta c = \sin^{-1}\left\{\sqrt{(1/\varepsilon r23)}\right\} \tag{7}$$

where the relative dielectric constant ∈r of the free space represents unity.

Therefore, in the nonradiative planar dielectric line of the second embodiment, the planar electromagnetic wave pw23 having a frequency not lower than the critical frequency fa, at which the angle of reflection θ is equal to the critical angle θc, propagates while being totally reflected repeatedly on the upper surface of the dielectric plate 23 contacting the slot 24 and on the lower surface of the dielectric plate 23 contacting the slot 25. Namely, the relative dielectric constant ∈r23 and the thickness t23 of the dielectric plate 23 are set so that a given propagation frequency fb is not lower than the critical frequency fa.

The spacing h41 between the external conductor upper and lower portions 41*c* and 44*c* is determined so that the TE-wave cut-off frequency of the plane parallel waveguide formed by the external conductor upper portion 41*c* and the electrode 21*a* is sufficiently higher than a given propagation frequency fb. This makes it possible to form a TE-wave cut-off region 42*a* between the external conductor upper portion 41*c* and the electrode 21*a* next to a free space 42*c* formed between the dielectric plate 23 and the external conductor upper portion 41*c*. Likewise, a TE-wave cut-off region 42*b* provided between the external conductor upper portion 41*c* and the electrode 21*b* is formed next to the free space 42*c* and opposite to the above-described cut-off region 42*a*.

Further, the spacing t42 between the external conductor upper portion 41*c* and the upper surface of the dielectric plate 23 is set to be equal to the spacing t43 between the external conductor lower portion 44*c* and the lower surface of the dielectric plate 23. Accordingly, a TE-wave cut-off region 43*a* provided between the external conductor lower portion 44*c* and the electrode 22*a* is formed next to a free space 43*c* formed between the external conductor lower portion 44*c* and the dielectric plate 23. Similarly, a TE-wave cut-off region 43*b* provided between the external conductor lower portion 44*c* and the electrode 22*b* is formed next to the free space 43*c* and opposite to the above-described cut-off region 43*a*.

Furthermore, the opposing external conductor lateral portions 41*a* and 41*b* form a plane parallel waveguide. The width W2 of the plane parallel waveguide is determined so that the TE-wave cut-off frequency of the waveguide is adequately higher than a given propagation frequency fb. Accordingly, the free space formed between the external conductor lateral portions 41*a* and 41*b* can be formed as a TE-wave cut-off region 42*d*. Likewise, the opposing external conductor lateral portions 44*a* and 44*b* form a plane parallel waveguide. The width W2 of the plane parallel waveguide is set so that the TE-wave cut-off frequency of the waveguide is sufficiently higher than a given propagation frequency fb. Accordingly, the free space formed between the external conductor lateral portions 44*a* and 44*b* can be formed as a TE-wave cut-off region 43*d*.

According to the nonradiative planar dielectric line constructed in accordance with the second embodiment, a propagating region 23*c* is formed in which a high-frequency signal whose frequency is not lower than the critical frequency fa propagates while being totally reflected alternately on the upper surface of the dielectric plate 23 contacting the slot 24 and on the lower surface of the dielectric plate 23 contacting the slot 25. In contrast, the cut-off regions 23*a*, 23*b*, 42*a*, 42*b*, 42*d*, 43*a*, 43*b*, and 43*d* are formed in which the high-frequency signal is attenuated. With this configuration, the planar wave propagates in the longitudinal direction of the dielectric plate 23 while concentrating the electromagnetic field energy of the high-frequency signal on the inside of and around the propagating region 23*c*.

In the nonradiative planar dielectric line of the second embodiment, the electromagnetic field energy is allowed to concentrate on the propagating region 23*c*, as discussed above, thus producing very little influence on the external conductors 41 and 44 which form the cut-off regions. Accordingly, the dimensional precision of the external conductors 41 and 44 may be determined to be rough. The relationships between the width W2 of the external conductor 41 or 44 and the phase constant β at 60 GHz which are obtained by calculations using the two-dimensional finite-element method (lossless system) are shown in FIGS. 4 and 5.

The dimensions and the relative dielectric constant of the model used for calculations are set as follows: t23 is 0.3 mm, W1 is 1.0 mm, t42 and t43 are 1.0 mm, and the relative dielectric constant ∈r23 of the dielectric plate 23 is 24. FIG. 4 illustrates a change in the phase constant α when the internal width W2 of the external conductor 41 or 44 is varied.

The dimensions and the relative dielectric constant of the model used for calculations are then set as follows: t23 is 0.3 mm, W1 is 1.0 mm, and W2 is 2.0 mm, and the relative dielectric constant ∈r23 of the dielectric plate 23 is 24. FIG. 5 illustrates a change in the phase constant β when the internal height t42 or t43 of the external conductor 41 or 44 is varied.

Figure 4:
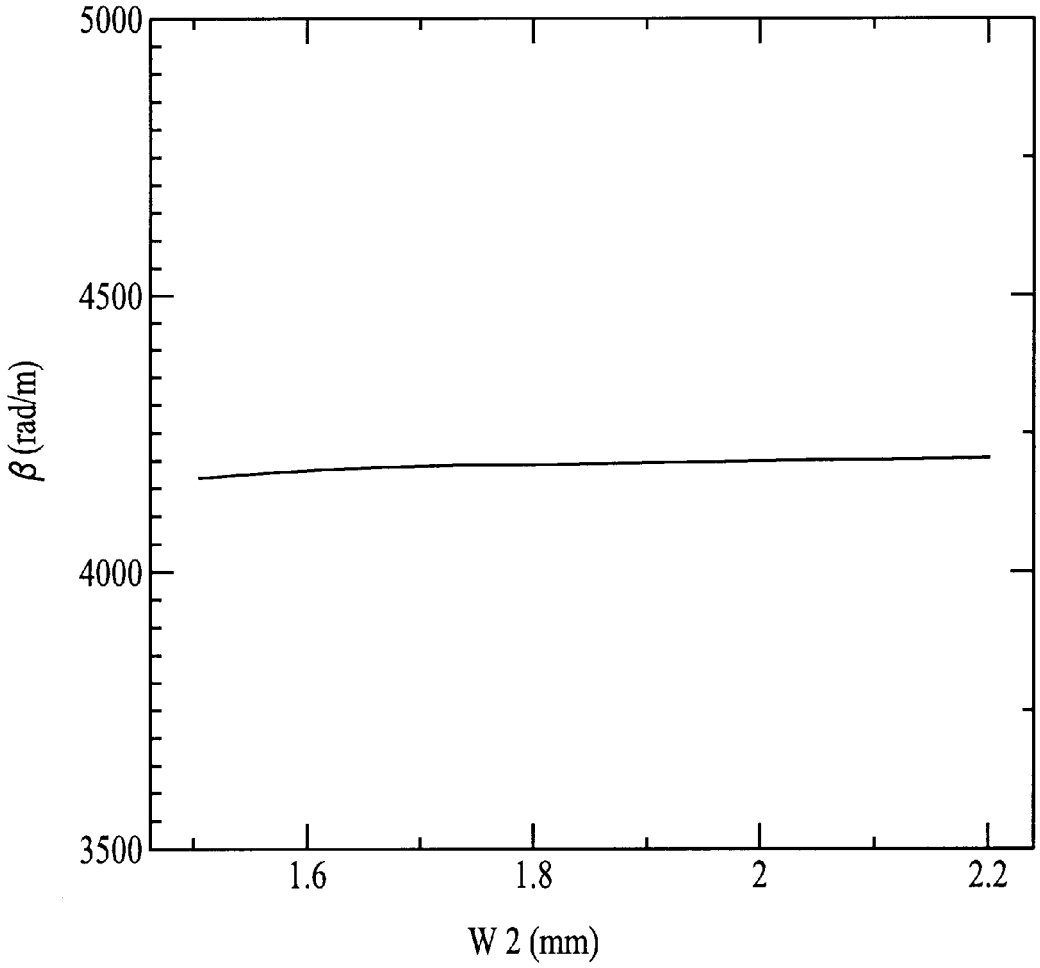
FIG. 4 is a diagram illustrating a change in the phase constant β with respect to the width W2 shown in FIG. 3A.
Figure 5:
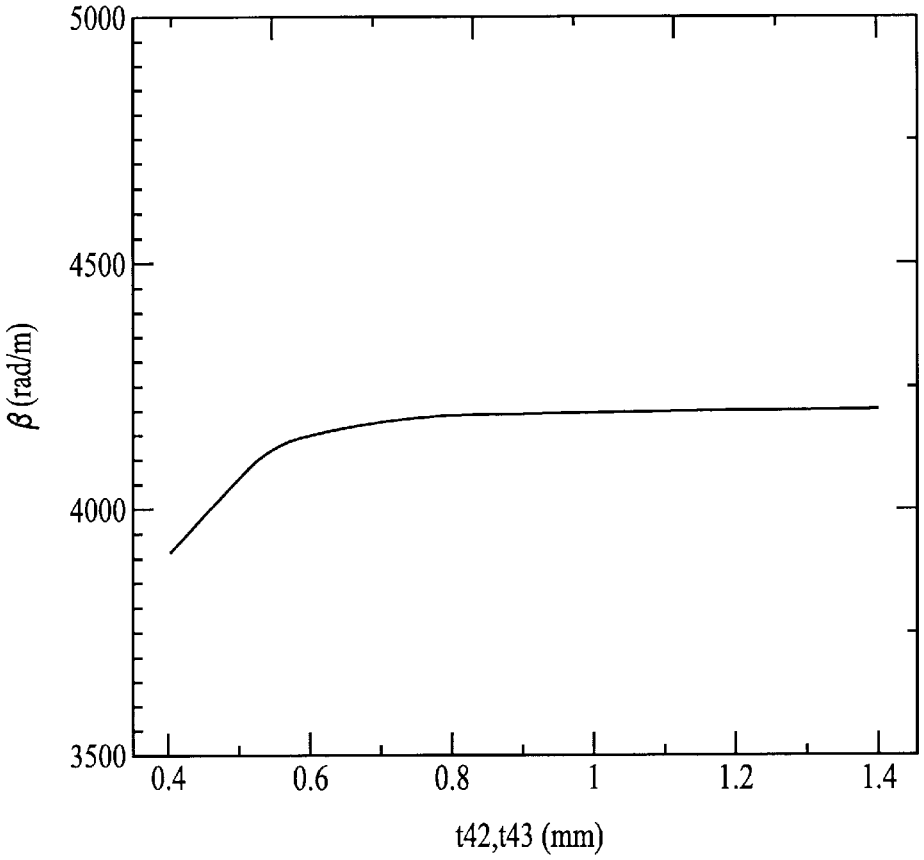
FIG. 5 is a diagram illustrating a change in the phase constant β with respect to t42 and t43 shown in FIG. 3A.

FIG. 4 reveals that a variation in the width W2 hardly changes the phase constant β, and FIG. 5 indicates that a variation in the internal height t42 or t43 of the external conductor 41 or 44 does not significantly change the phase constant β. For example, the spacing between two parallel electrodes, which are used to cut off a planar wave at 60 GHz having a plane of polarization parallel to the electrodes, is 2.5 mm. If the maximum spacing between the two electrodes is set to be not greater than 2.5 mm, the propagation of the planar wave is prevented. Accordingly, it is only essential that the dimensions W2, t42 and t43 of the external conductor 41 or 44 are designed so that a given propagation frequency is interrupted. Thus, even if the dimensional precision of the external conductor 41 or 44 is designed to be somewhat rough, a given high-frequency signal can propagate while concentrating the electromagnetic field energy on the inside of and around the propagating region 23*c*.

The same applies to the nonradiative planar dielectric line of the first embodiment. Even if the precision of the dimensions t26, t27, and W2 of the dielectric members 26 and 27, which respectively form the external electrode units 28 and 29, are designed to be somewhat rough, a given high-frequency signal can propagate while concentrating the electromagnetic field energy on the inside of and around the propagating region 23*c*.

For achieving a higher integrity and smaller size high-frequency circuit, it is desired that the spacing between adjacent lines (for example, a propagating region and a cut-off region) be approximately 0.2 to 0.3 times as long as the wavelength. One of the conditions for avoiding the interference between the adjacent lines even with such a small spacing is that 80% or higher the amount of electromagnetic field energy propagating in the line should be trapped. Namely, even if another line is brought closer to the area in which 80% or higher the amount of the electromagnetic field energy propagating in the line is trapped, parasitic coupling between the lines hardly occurs. If 90% or higher the amount of electromagnetic field energy propagating in the line is trapped, the interference between the lines is further alleviated.

The above-described condition for avoiding the interference between the lines is more specifically described by referring to the foregoing second embodiment as an example. A determination is made in the following manner to the relative dielectric constant ∈r23 and the thickness t23 of the dielectric plate 23 required for trapping 80% or higher the amount of the electromagnetic field energy within the zone, which is formed by the propagating region 23*c* and each of the cut-off regions 23*a* and 23*b* extended from the propagating region 23*c* by an amount of 0.2 times as long as the wavelength.

The electromagnetic field distribution within the cross section of the dielectric plate 23 is first determined according to the finite-element method. The perturbation method is then applied to the obtained electromagnetic field distribution, thereby determining the relationship between the relative dielectric constant and the ratio obtained by normalizing the area of leakage L, which is determined in the following manner, by the wavelength λg. The area of leakage L represents an amount of leakage of electromagnetic energy to each of the cut-off regions 23*a* and 23*b* from the propagating region 23*c* when the degree of concentration of energy on the dielectric plate 23 (hereinafter referred to as "the amount of energy trapped") reaches 80%.

Figure 3B:
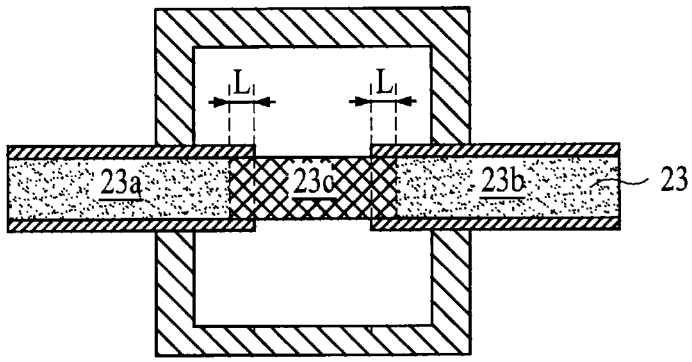

FIG. 3B illustrates the relationship between the energy trapped zone and the area of leakage L. In FIG. 3B, L indicates the area of leakage of energy measured from the propagating region 23*c* to each of the cut-off regions 23*a* and 23*b* when 80% of energy is trapped in the cross hatched portion.

Figure 6:
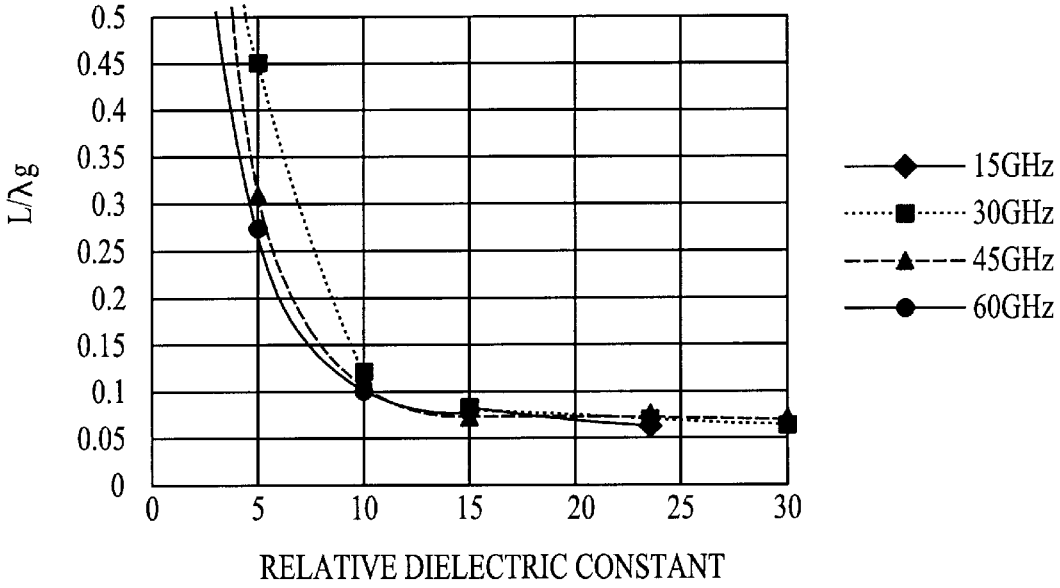
FIG. 6 is a diagram illustrating the relationship of the dimension of a predetermined portion to the relative dielectric constant of the dielectric plate by using the frequency as a parameter.

Then, the relationship of L/λg to the relative dielectric constant is obtained by using the nonradiative planar dielectric line shown in FIG. 3A. The dimensions of the dielectric line are determined as follows: t42 and t43 are 1.0 mm, W1 is a width obtained when the characteristic impedance of the line is 50Ω, and the thickness t23 of the dielectric plate 23 is 0.5 mm. FIG. 6 illustrates the relationship of L/λg (vertical axis) to the relative dielectric constant ∈r23 (horizontal axis) by using the frequency as a parameter in order to trap 80% or higher the amount of energy. As the frequency, 15 GHz, 30 GHz, 45 GHz, and 60 GHz are selected. FIG. 6 reveals that the relative dielectric constant ∈r23 should be 10 or higher regardless of the frequency when L/λg is 0.2 or smaller in order to trap 80% or higher the amount of energy.

Figure 7:
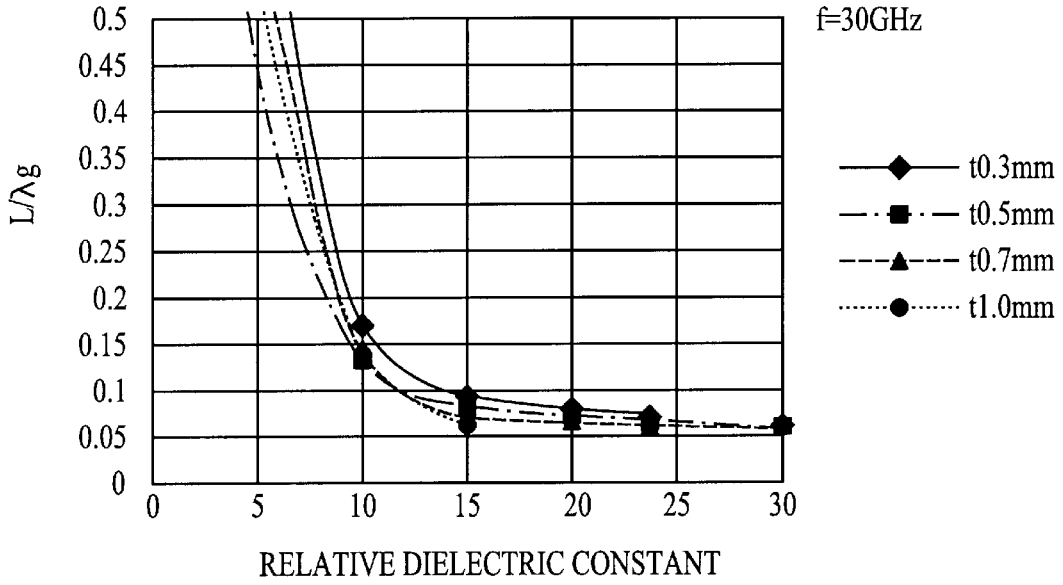
FIG. 7 is a diagram illustrating the relationship of the dimension of a predetermined portion to the relative dielectric constant of the dielectric plate by using the thickness of the dielectric plate as a parameter.

Then, the conditions of the dielectric line illustrated in FIG. 3A are determined as follows: t42 and t43 are 0.7 mm, W1 is a width obtained when the characteristic impedance of the line is 50Ω, and the frequency is 30 GHz. FIG. 7 illustrates the relationship of L/λg (vertical axis) to the relative dielectric constant ∈r23 (horizontal axis) by using the thickness t23 of the dielectric plate 23 as a parameter in order to trap 80% or higher the amount of energy. As the thickness t23 of the dielectric plate 23, 0.3 mm, 0.5 mm, 0.7 mm, and 1.0 mm are selected. FIG. 7 shows that the thickness t23 of the dielectric plate 23 should be 0.3 mm or greater and the relative dielectric constant ∈r23 should be 10 or higher when L/λg is 0.2 or smaller in order to trap 80% or higher the amount of energy.

However, in terms of the structure of the nonradiative planar dielectric line, the thickness t23 of the dielectric plate 23 and the internal heights t42 and t43 of the external conductors should satisfy the following conditions in order to suppress the coupling of the electromagnetic wave with unwanted modes.

$$t23 \leqq \lambda g/2$$

(λg: the wavelength in the dielectric plate)

$$t42,\ t43 \leqq \lambda o/2$$

(λo: the wavelength in the free space)

Hence, FIGS. 6 and 7 reveal that approximately 80% or higher the amount of energy is trapped within the propagating region 23*c* and the area of leakage L of the cut-off regions 23*a* and 23*b* illustrated in FIG. 3B if the relative dielectric constant ∈r23 of the dielectric plate 23 is 10 or higher and the thickness t23 of the dielectric plate 23 is 0.3 mm or greater.

Subsequently, the relative dielectric constant ∈r23 and the thickness t23 of the dielectric plate 23 required for trapping 90% or higher the amount of energy within the above zone when L/λg is 0.2 or smaller are determined.

Figure 8:
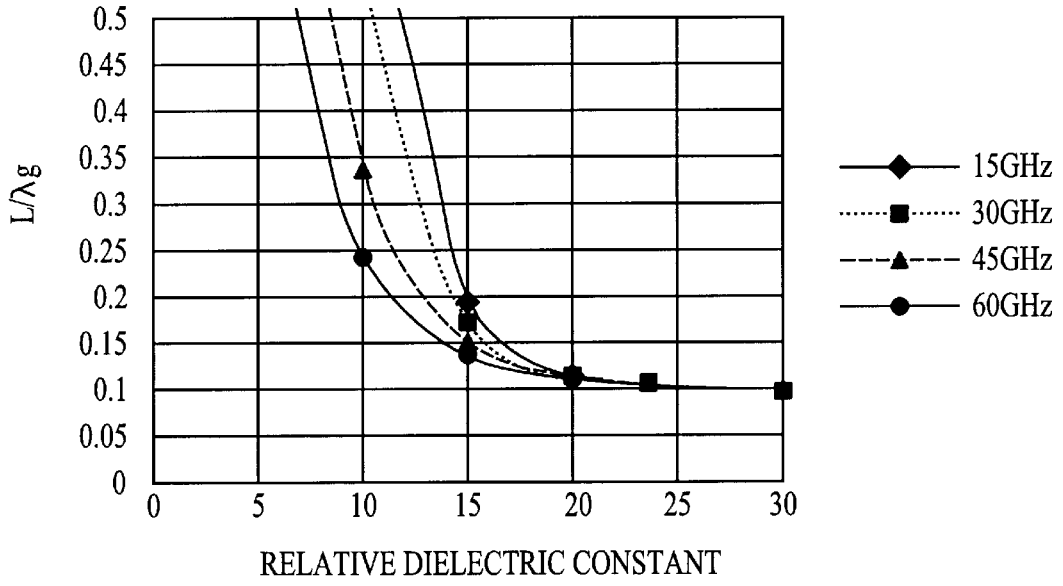
FIG. 8 is a diagram illustrating the relationship of the dimension of a predetermined portion to the relative dielectric constant of the dielectric plate by using the frequency as a parameter.

The relationship of the width W2 to the relative dielectric constant ∈r23 is first obtained by using the nonradiative planar dielectric line illustrated in FIG. 3A. The dimensions of the dielectric line are determined as follows: t42 and t43 are 1.0 mm, W1 is a width obtained when the characteristic impedance of the line is 50Ω, and the thickness t23 of the dielectric plate 23 is 0.5 mm. FIG. 8 illustrates the relationship of the width W2 (L/λg) to the relative dielectric constant ∈r23 using the frequency as a parameter in order to trap 90% or higher the amount of energy. In FIG. 8, the vertical axis represents the ratio (L/λg) obtained by normalizing the width W2 by the wavelength of the electromagnetic wave propagating within the dielectric plate, while the horizontal axis indicates the relative dielectric constant ∈r23 of the dielectric plate 23. As the frequency, 15 GHz, 30 GHz, 45 GHz, and 60 GHz are selected. FIG. 8 indicates that the relative dielectric constant ∈r23 of the dielectric plate 23 should be 15 or higher regardless of the frequency when L/λg is 0.2 or smaller in order to trap 90% or higher the amount of energy trapped.

Figure 9:
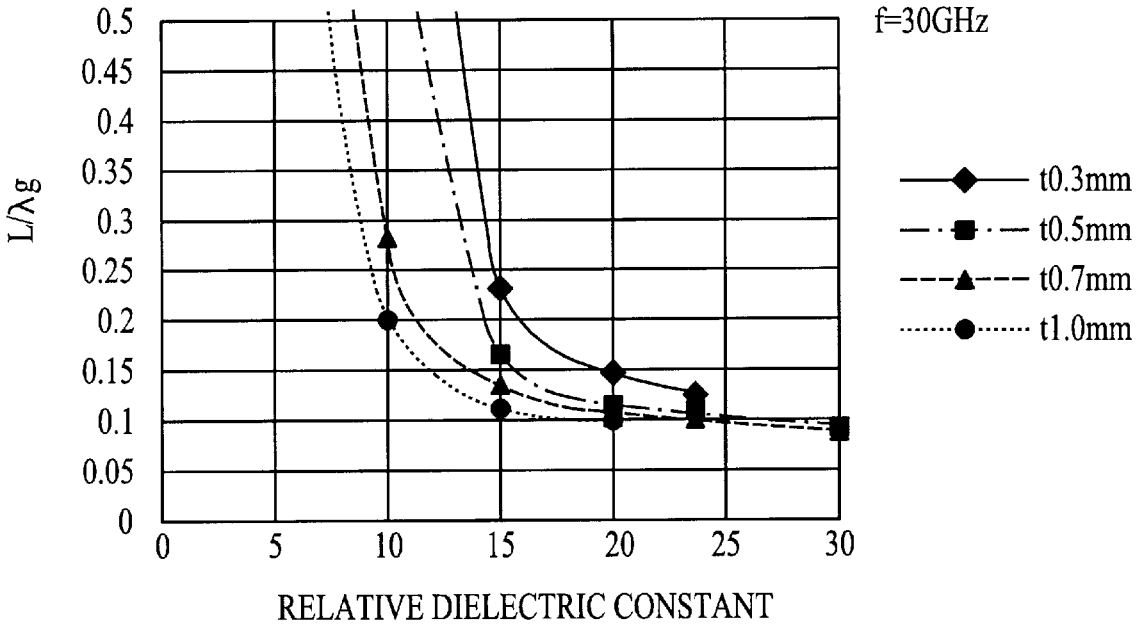
FIG. 9 is a diagram illustrating the relationship of the dimension of a predetermined portion to the relative dielectric constant of the dielectric plate using the thickness of the dielectric plate as a parameter.

Then, the relationship of L/λg to the relative dielectric constant ∈r23 is further obtained by employing the nonradiative planar dielectric line shown in FIG. 3A. The conditions of the dielectric line are determined as follows: t42 and t43 are 0.7 mm, W1 is a width obtained when the characteristic impedance of the line is 50Ω, and the frequency is 30 GHz. FIG. 9 illustrates the relationship of L/λg (vertical axis) to the relative dielectric constant ∈r23 (horizontal axis) by using the thickness t23 of the dielectric plate 23 as a parameter in order to trap 90% or higher the amount of energy. As the thickness t23 of the dielectric plate 23, 0.3 mm, 0.5 mm, 0.7 mm, and 1.0 mm are selected. FIG. 9 indicates that the thickness t23 of the dielectric plate 23 should be 0.3 mm or greater and the relative dielectric constant ∈r23 is 18 or higher when L/λg is 0.2 or smaller in order to trap 90% or higher the amount of energy.

As noted above, however, the thickness t23 of the dielectric plate 23 and the internal heights t42 and t43 of the external conductors should satisfy the following conditions in order to suppress the coupling of the electromagnetic wave with unwanted modes.

$$t23 \leqq \lambda g/2$$

(λg: the wavelength in the dielectric plate)

$$t42, t43 \leqq \lambda o/2$$

(λo: the wavelength in the free space)

As a consequence, FIGS. 8 and 9 reveal that approximately 90% or higher the amount of energy is trapped within the propagating region 23*c* and the area of leakage L of the cut-off regions 23*a* and 23*b* shown in FIG. 3B if the relative dielectric constant ∈r23 is 18 or higher and the thickness t23 is 0.3 mm or greater.

The above-described relationships apply to the nonradiative planar dielectric line constructed in accordance with the first embodiment. The conditions of the dielectric line are determined as follows: the relative dielectric constant ∈r23 of the dielectric plate 23 is 10 or higher, and the thickness t23 of the dielectric plate 23 is 0.3 mm or greater. Then, approximately 80% or higher the amount of energy is trapped within the propagating region 23*c* and part of the cut-off regions 23*a* and 23*b*(corresponding to the area L which satisfies the condition of L/λg<0.2 shown in FIG. 3B). Further, approximately 90% or higher the amount of energy is trapped within the propagating region 23*c* and the above part of the cut-off regions 23*a* and 23*b* if the relative dielectric constant ∈r23 is set to be 18 or higher and the thickness t23 of the dielectric plate 23 is set to be 0.3 mm or greater.

Figure 10A:
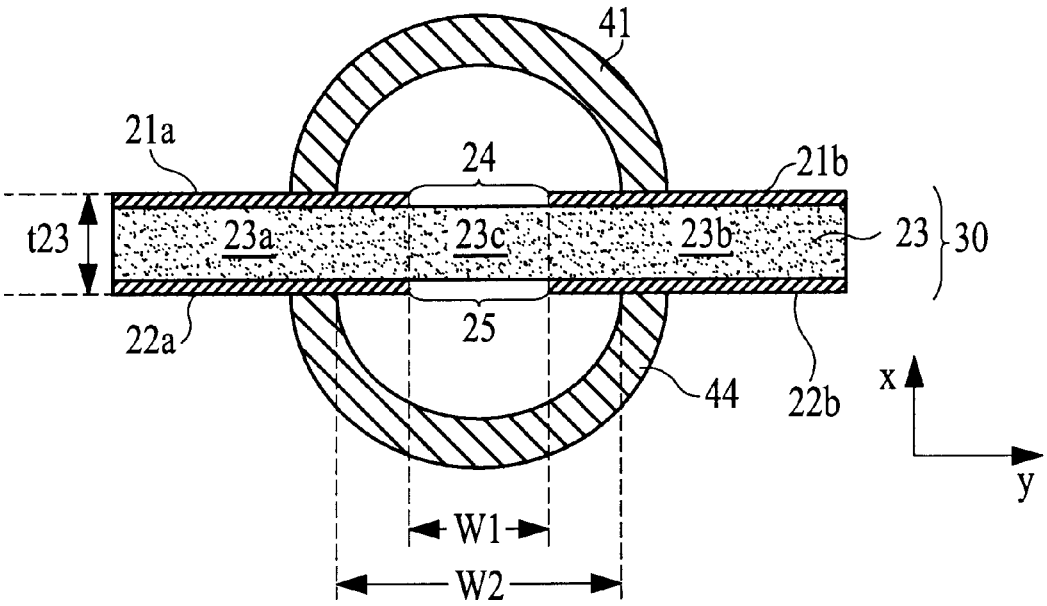
FIG. 10, which is comprised of FIGS. 10A and 10B, is a sectional view illustrating a nonradiative planar dielectric line according to a third embodiment of the present invention.
Figure 10B:
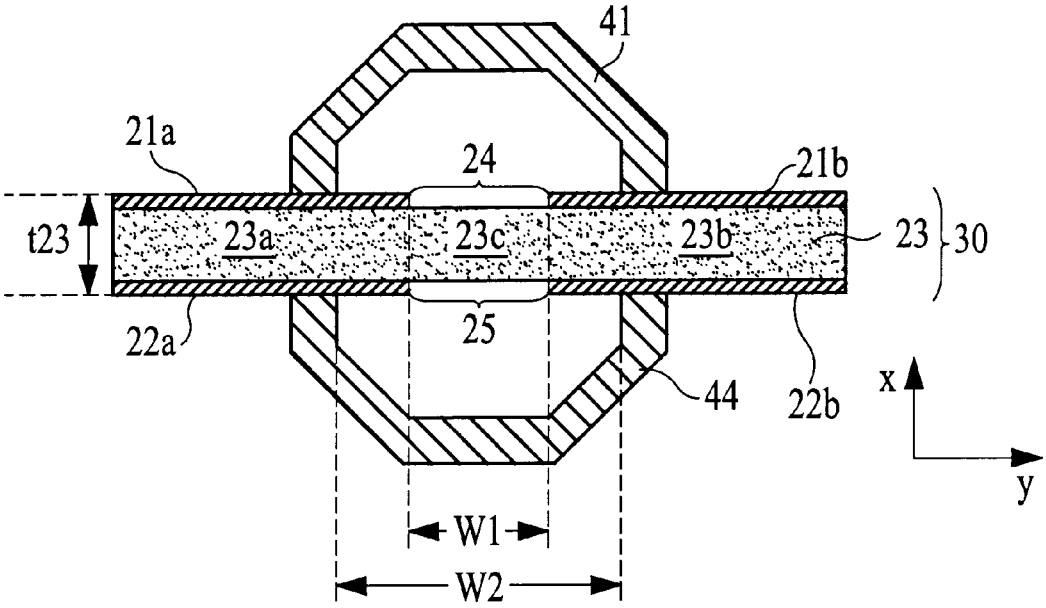

FIG. 10 is a sectional view illustrating the configuration of a nonradiative planar dielectric line according to a third embodiment of the present invention. In the first and second embodiments, the cross section of the external electrodes or external conductors is formed in a rectangular shape. In the third embodiment, however, the cross section of external conductors 41 and 44 may be semi-circular, as shown in FIG. 10A, or may be polygonal, as illustrated in FIG. 10B. It should be noted, however, that the dimensions of the external conductors 41 and 44 are determined so that the spaces surrounded by the external conductors 41 and 44 serve as cut-off regions with respect to the main frequency.

Figure 11:
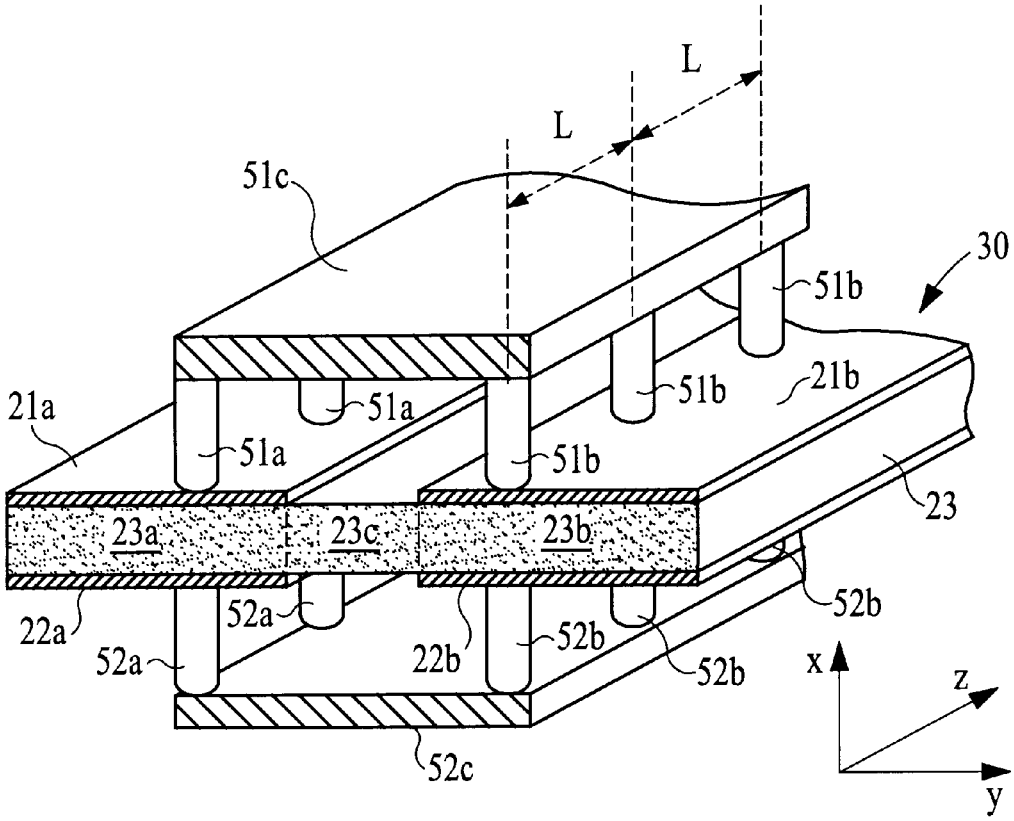
FIG. 11 is a perspective view, partially cut away, illustrating a nonradiative planar dielectric line according to a fourth embodiment of the present invention.

FIG. 11 is a perspective view partially illustrating a nonradiative planar dielectric line according to a fourth embodiment of the present invention. In the first through third embodiments, external electrodes or external conductors are continuously provided in such a manner that they span the slot formed between the two electrodes on the dielectric plate. Rod-like electrodes may be, however, used, as illustrated in FIG. 11, to connect external conductors to electrodes formed on the dielectric plate. In FIG. 11, rod-like electrodes 51*a*, 51*b*, 52*a*, and 52*b* are positioned so that the spacing L between the adjacent rod-like electrodes is not greater than one half the wavelength of the electromagnetic wave propagating in the free space. An upper conductor plate 51*c* is provided to face parallel to electrodes 21*a* and 21*b*, while a lower conductor plate 52*c* is provided to face parallel to electrodes 22*a* and 22*b*. With this configuration, cut-off regions similar to those of the foregoing embodiments can be formed by the rod-like electrodes 51*a*, 51*b*, 52*a*, and 52*b* and the conductor plates 51*c* and 52*c*.

Figure 12:
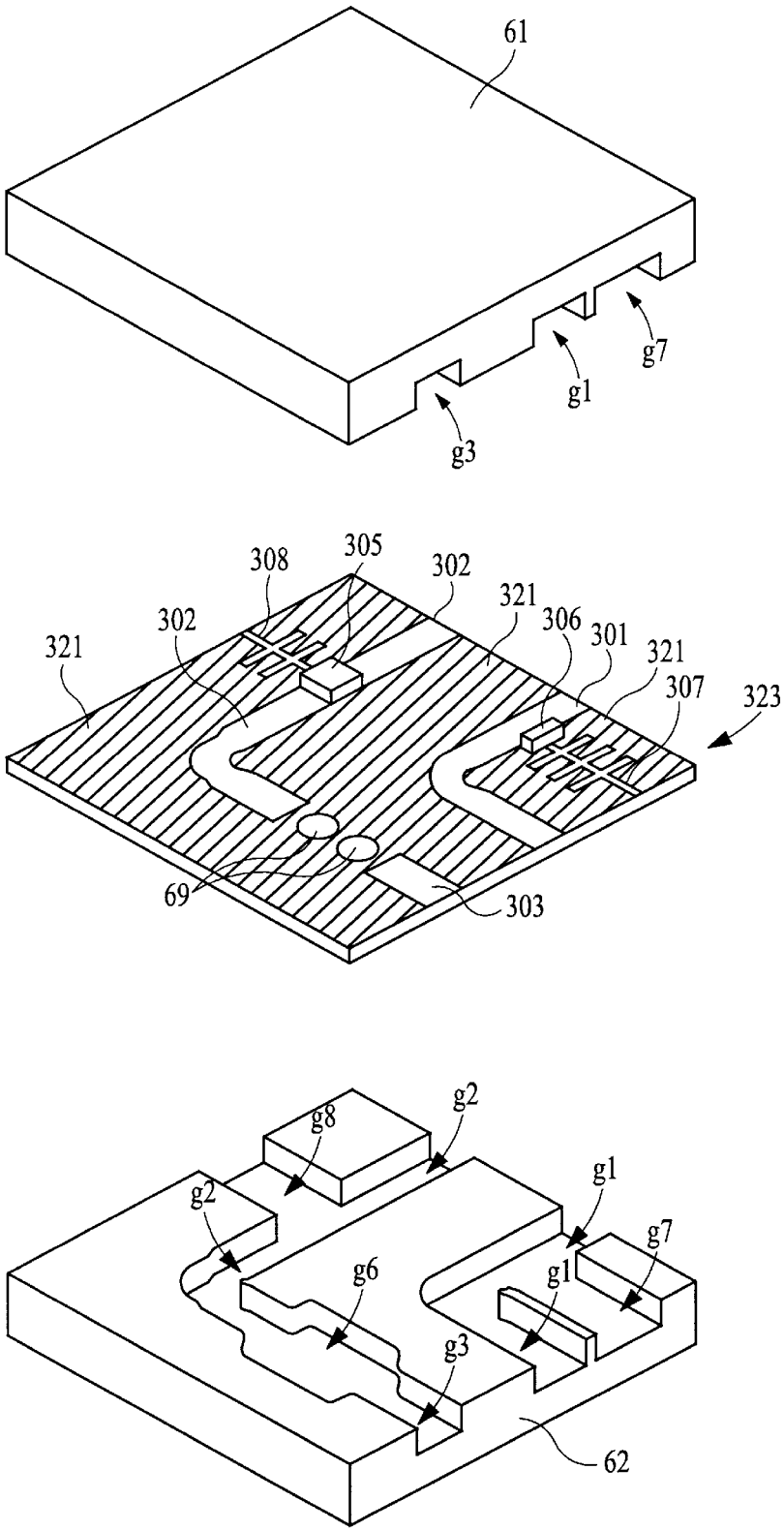
FIG. 12 is an exploded perspective view illustrating a nonradiative planar dielectric line integrated circuit according to a fifth embodiment of the present invention.
Figure 13:
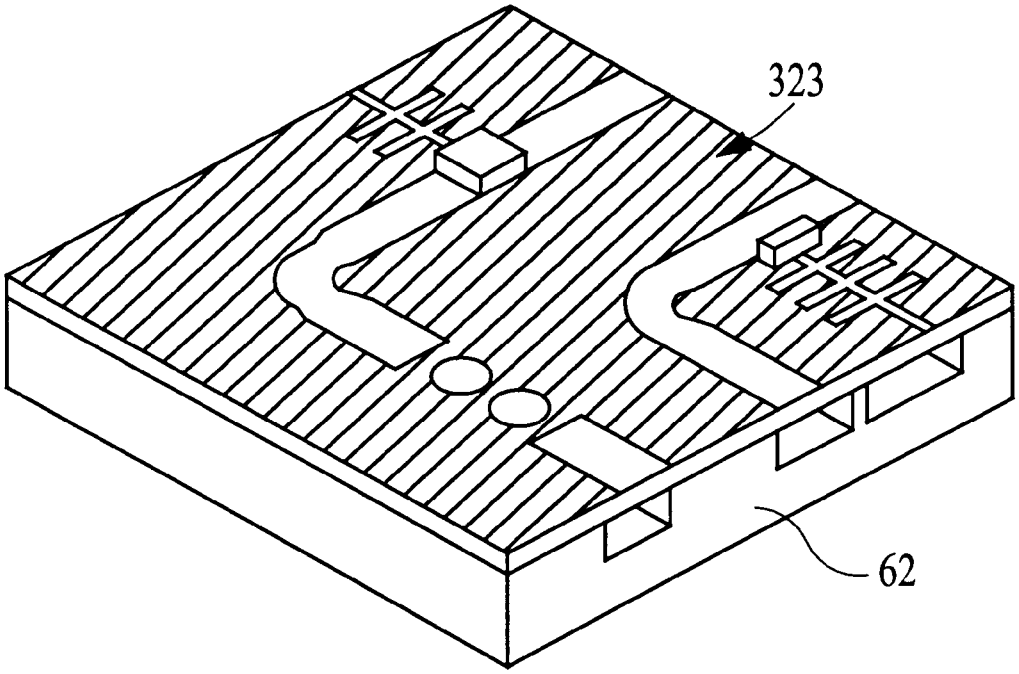
FIG. 13 is a perspective view illustrating the state in which the integrated circuit shown in FIG. 12 is being assembled.
Figure 14:
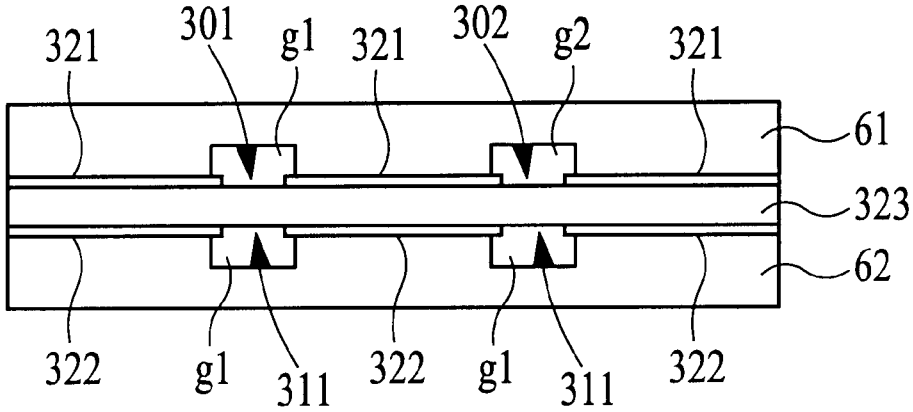
FIG. 14 is a side view illustrating the end face of the integrated circuit shown in FIG. 12.
Figure 15:
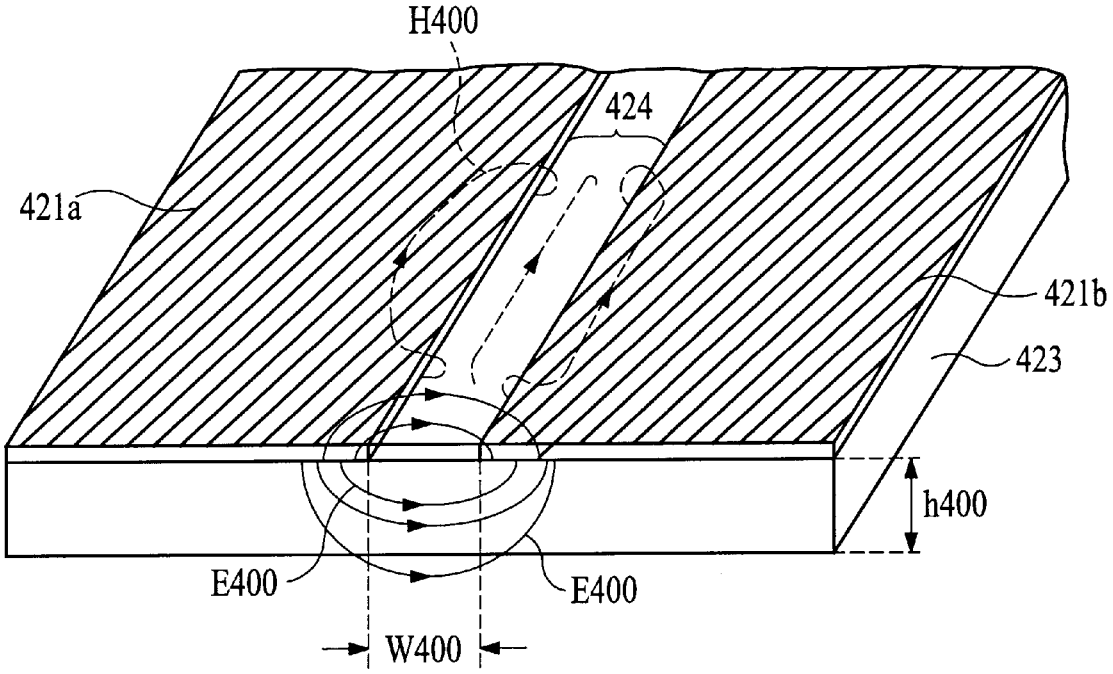
FIG. 15 is a perspective view illustrating the structure of a known slot line.

A description is now given of the configuration of a nonradiative planar dielectric line integrated circuit according to a fifth embodiment of the present invention with reference to FIGS. 12 through 14.

FIG. 12 is an exploded perspective view illustrating a surface-mount-type planar dielectric line integrated circuit. Reference numerals 61 and 62 respectively represent upper and lower conductor plates between which a transmission substrate 323 is interposed, thereby forming an integrated circuit. Formed on the obverse surface of the transmission substrate 323 are various types of electrode patterns 321, thereby providing slots 301, 302, and 303. Resonator forming regions 66 and 69 are also provided between the slots 302 and 303. Moreover, a circuit component module (an electronic component, such as an IC) 305 is mounted on part of the slot 302. Another circuit component module 306 is also mounted in the vicinity of the slot 301. Bias lines 308 and 307 for applying a bias voltage to the circuit component modules 305 and 306, respectively, are formed on the transmission substrate 323. Electrodes having the same patterns as the electrode patterns 321 are formed on the reverse surface of the transmission substrate 323. Grooves indicated by g1 through g8 are provided in the lower conductor plate 62, and mirror-symmetrical grooves are provided in the upper conductor plate 61.

FIG. 13 is a perspective view illustrating the state in which the transmission substrate 323 is mounted on the lower conductor plate 62 shown in FIG. 12. FIG. 14 is a side view (the direction of which is the right distal end face in FIG. 12) illustrating a nonradiative planar dielectric line integrated circuit assembled by further mounting the upper conductor plate 61 on the partial assembly shown in FIG. 13. As illustrated in FIG. 14, the slots 301 and 302 are formed on the upper surface of the transmission substrate 323, while the slots 311 and 312, which oppose the slots 301 and 302, respectively, are formed on the lower surface of the transmission substrate 323. Then, the conductor plates 61 and 62 are placed to cover the slots 301, 302, 311, and 312 via the grooves g1 and g2. In this manner, according to a sandwich structure of the two conductor plates and the intervening transmission substrate, electronic components can be integrated with a plurality of nonradiative planar dielectric lines.

Additionally, according to the sandwich structure shown in FIG. 14, the electrodes 321, 321, and 321 on the upper surface of the transmission substrate 323 are electrically connected to each other via the conductor plate 61, and the electrodes 322, 322, and 322 on the lower surface of the transmission substrate 323 are electrically connected to each other via the conductor plate 62. Thus, the individual electrodes are at the same potential, thereby preventing the generation of unwanted resonance modes between the electrodes.

As is seen from the foregoing description, the nonradiative planar dielectric line of the present invention offers the following advantages.

The area formed between the first slot and the second slot serves as a propagating region of an electromagnetic wave. Moreover, the upper conductor is electrically connected to the first and second electrodes and also covers the first slot, and the lower conductor is electrically connected to the third and fourth electrodes and also covers the second slot. With this configuration, the planar wave is blocked by the above electrodes. Further, even if the first slot and the second slot are not completely symmetrical, the radiating wave generated by the asymmetric characteristics of the slots is interrupted by the upper and lower conductors, thereby suppressing radiation losses, which further reduces transmission losses. If the dielectric plate for use in the dielectric line has a relative dielectric constant of 10 or higher and a thickness of 0.3 mm or greater, approximately 80% or higher the amount of energy is trapped within a zone which is formed of a slot and a portion 0.4 times as long as the wavelength. If the dielectric plate for use in the dielectric line has a relative dielectric constant of 18 or higher and a thickness of 0.3 mm or greater, approximately 90% or higher the amount of energy is trapped within a zone which is formed of a slot and a portion 0.4 times as long as the wavelength. In either case, the lines can be positioned in proximity with each other, thereby achieving a higher integrity and smaller circuit.

A dielectric member having a dielectric constant lower than the dielectric plate is interposed between the transmission substrate and each of the upper and lower conductors. Accordingly, the planar wave can propagate within the propagating region even with the reduced thickness of the dielectric plate upon comparison with known dielectric lines at the same frequency. Thus, the overall nonradiative planar dielectric line can be miniaturized.

In forming an integrated circuit using the above type of dielectric line, the assembly of the transmission substrate and the conductor plates is simplified even when a plurality of propagating regions are provided, thereby achieving a reduction in the cost.

In forming an integrated circuit, circuit devices, such as an oscillation diode and a mixer diode, are mounted on the transmission substrate, which is then assembled with the upper and lower conductors. It is thus possible to easily form a nonradiative planar dielectric line integrated circuit having a planar circuit.

What is claimed is:

1. A nonradiative planar dielectric line comprising:

a transmission substrate including a first slot and a second slot, said first slot having a predetermined width and provided between a first electrode and a second electrode on a first main surface of a dielectric plate which has a relative dielectric constant of 10 or higher and a thickness of 0.3 mm or greater, said second slot having a width substantially equal to the width of said first slot and provided between a third electrode and a fourth electrode on a second main surface of said dielectric plate, said first slot and said second slot facing each other, an area formed between said first slot and said second slot serving as a propagating region of an electromagnetic wave;

a first conductor electrically connected to said first electrode and said second electrode and covering said first slot; and a second conductor electrically connected to said third electrode and said fourth electrode and covering said second slot.

2. A nonradiative planar dielectric line comprising:

a transmission substrate including a first slot and a second slot, said first slot having a predetermined width and provided between a first electrode and a second electrode on a first main surface of a dielectric plate which has a relative dielectric constant of 18 or higher and a thickness of 0.3 mm or greater, said second slot having a width substantially equal to the width of said first slot and provided between a third electrode and a fourth electrode on a second main surface of said dielectric plate, said first slot and said second slot facing each other, an area formed between said first slot and said second slot serving as a propagating region of an electromagnetic wave;

a first conductor electrically connected to said first electrode and said second electrode and covering said first slot; and a second conductor electrically connected to said third electrode and said fourth electrode and covering said second slot.

3. A nonradiative planar dielectric line according to one of claims 1 and 2, wherein a dielectric member having a dielectric constant lower than said dielectric plate is interposed between said transmission substrate and each of said first conductor and said second conductor.

4. A nonradiative planar dielectric line according to claim 3, wherein said first conductor and said second conductor are grooved to match the configurations of said first slot and said second slot, and the grooved surface of each of said first conductor and said second conductor is positioned to face said transmission substrate.

5. A nonradiative planar dielectric line according to one of claims 1 and 2, wherein said first conductor and said second conductor are grooved to match the configurations of said first slot and said second slot, and the grooved surface of each of said first conductor and said second conductor is positioned to face said transmission substrate.

6. A nonradiative planar dielectric line integrated circuit comprising:

a transmission substrate including a first slot, a second slot, and a circuit device mounted on said transmission substrate, said first slot having a predetermined width and provided between a first electrode and a second electrode on a first main surface of a dielectric plate which has a relative dielectric constant of 10 or higher and a thickness of 0.3 mm or greater, said second slot having a width substantially equal to the width of said first slot and provided between a third electrode and a fourth electrode on a second main surface of said dielectric plate, said first slot and said second slot facing each other, an area formed between said first slot and said second slot serving as a propagating region of an electromagnetic wave;

a first conductor electrically connected to said first electrode and said second electrode and covering said first slot; and a second conductor electrically connected to said third electrode and said fourth electrode and covering said second slot.

7. A nonradiative planar dielectric line integrated circuit comprising:

a transmission substrate including a first slot, a second slot, and a circuit device mounted on said transmission substrate, said first slot having a predetermined width and provided between a first electrode and a second electrode on a first main surface of a dielectric plate which has a relative dielectric constant of 18 or higher and a thickness of 0.3 mm or greater, said second slot having a width substantially equal to the width of said first slot and provided between a third electrode and a fourth electrode on a second main surface of said dielectric plate, said first slot and said second slot facing each other, an area formed between said first slot and said second slot serving as a propagating region of an electromagnetic wave;

a first conductor electrically connected to said first electrode and said second electrode and covering said first slot; and a second conductor electrically connected to said third electrode and said fourth electrode and covering said second slot.

8. A nonradiative planar dielectric line integrated circuit according to one of claims 6 and 7, wherein a dielectric member having a dielectric constant lower than said dielectric plate is interposed between said transmission substrate and each of said first conductor and said second conductor.

9. A nonradiative planar dielectric line integrated circuit according to claim 8, wherein said first conductor and said second conductor are grooved to match the configurations of said first slot and said second slot, and the grooved surface of each of said first conductor and said second conductor is positioned to face said transmission substrate.

10. A nonradiative planar dielectric line integrated circuit according to one of claims 6 and 7, wherein said first conductor and said second conductor are grooved to match the configurations of said first slot and said second slot, and the grooved surface of each of said first conductor and said second conductor is positioned to face said transmission substrate.

* * * * *